US006658223B2

(12) United States Patent
Nishimura et al.

(10) Patent No.: US 6,658,223 B2
(45) Date of Patent: Dec. 2, 2003

(54) TONER SEAL FOR A CLEANING DEVICE

(75) Inventors: Ryoji Nishimura, Osaka (JP); Shinsuke Kawashima, Osaka (JP); Tsuyoshi Koyanagi, Osaka (JP); Satoru Yonemoto, Osaka (JP); Yuzo Onishi, Osaka (JP); Hironori Takahashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/283,068

(22) Filed: Oct. 30, 2002

(65) Prior Publication Data

US 2003/0099480 A1 May 29, 2003

(30) Foreign Application Priority Data

Nov. 29, 2001 (JP) ..... 2001-364870
Nov. 30, 2001 (JP) ..... 2001-365424

(51) Int. Cl.[7] ..... G03G 15/08; G03G 21/00
(52) U.S. Cl. ..... 399/102; 399/343; 399/353
(58) Field of Search ..... 399/102, 98, 123, 399/343, 350, 353; 15/256.5

(56) References Cited

U.S. PATENT DOCUMENTS 4,400,082 A * 8/1983 Kiba ..... 399/102
5,455,665 A * 10/1995 Baba et al. ..... 15/256.5
5,655,178 A * 8/1997 Ishikawa et al. ..... 399/102
5,774,765 A * 6/1998 Hirota et al. ..... 399/102

FOREIGN PATENT DOCUMENTS

JP 10319812 A * 12/1998 ..... G03G/15/08
JP 2000131941 A * 5/2000 ..... G03G/15/08

* cited by examiner

*Primary Examiner*—Fred L Braun
(74) *Attorney, Agent, or Firm*—Smith, Gambrell & Russell, LLP

(57) ABSTRACT

A cleaning device according to the present invention has first seals and a second seal adhered so as to partly overlap each other for sealing a space between a housing of the cleaning device and the surface of a photoreceptive member. The first seals include seal bases and a flocked sheet layered on the seal bases. The portion of the seal base where the second seal overlaps is made smaller in thickness than the portion of the seal base where the second seal does not overlap. Therefore, no step is formed in the overlapped portion, thereby preventing toner leakage.

6 Claims, 8 Drawing Sheets

TONER SEAL FOR A CLEANING DEVICE

BACKGROUND OF THE INVENTION

1. Field of the Invention

The present invention relates to a cleaning device to be applied to an image forming apparatus for forming images by an electrophotographic system such as a copying machine, a printer, a facsimile and the like.

2. Description of Related Arts

An image forming apparatus for forming images by an electrophotographic system is provided with, for example, a photosensitive drum. Electrostatic latent image is formed on the surface of the photosensitive drum and then developed by using toner, and subsequently the toner image is transferred on a paper sheet.

After the toner image has been transferred on a paper sheet, the surface of the photosensitive drum is not completely free from toner but usually has residual toner thereon. This residual toner is unnecessary for the next image forming cycle. Therefore, if the residual toner is left as it is, it appears as undesirable blots on the next image, thus causing to lower the image quality.

Therefore, cleaning devices have been adopted for scraping toner remaining on the surface of a photosensitive drum after toner image transferring.

A cleaning device is disposed in a position opposed to the surface of the photosensitive drum after toner image transferring, so as to scrape toner remaining on the surface of the photosensitive drum by rubbing off the same using a fur brush, blade or the like.

If toner leaks through clearances between the cleaning device and the photosensitive drum, the toner stains not only copy sheets but also an optical system, a lamp and the like, thereby causing to lower the copy quality. Therefore, clearances between end faces of a housing for forming a cleaning space, which end faces define an opening opposed to the photosensitive drum surface, and the circumferential surface of the photosensitive drum are generally sealed with a plurality of seals.

Such seals are, for example, side seals (flocked seals) adhered to the housing end faces opposed to both longitudinal ends of the photosensitive drum respectively, and an upstream seal (generally, seal made of a urethane sheet) elongated in the direction of the longitudinal axis of the photosensitive drum and contacting the photosensitive drum on the upstream side of the opening as viewed in the direction of the rotation of the photosensitive drum.

Since the side seals and the upstream seal are adhered in such a manner that they overlap each other at the both longitudinal ends, steps, namely, portions different in level are apt to be formed. If steps are formed, scraped toner is liable to leak from those portions. If, for the purpose of eliminating such steps, the cleaning device is intensely urged against the circumferential surface of the photosensitive drum to absorb the steps by the deformation of the side seals (flocked seals), the upstream seal (urethane seal) is sometimes plucked away by the rotation of photosensitive drum.

Further, each of the side seals comprises a flocked sheet and a seal base, and if steps are provided on the housing end faces of the cleaning device in order to absorb and eliminate the steps formed by the overlapping of the side seals and the upstream seal, the seal base is not in line with the step formed on the housing end face. As a result, it proves that a clink is produced between the step portion on the housing end face and the seal base of each side seal, and disadvantageously, toner leakage through the clink is caused.

Further, especially each side seal (flocked seal) among these seals is intensely urged against the circumferential surface of the photosensitive drum and receives, on the surface thereof, the rotating force of the photosensitive drum. Therefore, whole of each side seal receives a displacing force from the upstream side toward the downstream side as viewed in the direction of the rotation of the photosensitive drum, so that sometimes a portion of the side seal adhered by means of a double-sided tape is displaced or peeled off from the upstream side in the direction of the rotation.

If such displacement or peeling off of the side seal is caused, a clearance is formed between the housing end face of a cleaning unit and the circumferential surface of the photosensitive drum. When the toner in the cleaning space gushes through the clink to stain the inside of the image forming apparatus and an optical system, sometimes it causes problems with the copy quality.

SUMMARY OF THE INVENTION

The present invention has been made in the abovementioned background. An object of the present invention is to provide a cleaning device having an excellent sealing ability with respect to the surface of a photosensitive member and capable of preventing recovered toner leakage.

Another object of the present inventions is to provide a cleaning device causing no displacement or peeling off of side seals and thereby capable of preventing recovered toner leakage.

The present invention provides a cleaning device for scraping toner remaining on the surface of a photosensitive member after toner image transferring, having first seals and a second seal adhered to end faces of a housing in such a manner as to partly overlap each other in order to seal the space between the housing end faces and the surface of the photosensitive member. Each first seal includes seal bases and a flocked sheet layered on the seal bases, and a seal base where the second seal overlaps is made smaller in thickness than the other seal base where the second seal does not overlap.

According to the present invention, the first seals and the second seal are adhered to the housing end faces of the cleaning device in such a manner that the first seals and the second seal partly overlap each other. However, since the seal base of the portion of the first seal where the second seal overlaps is made smaller in thickness, no step is formed in the portion where the first seal and the second seal overlap each other.

Further, in another embodiment, a cleaning device according to the present invention includes a seal having a flocked sheet adhered to the housing end face and a pressing member for pressing a part of this seal from the upper surface thereof, and the pressing member is characterized by pressing a portion of the seal abutting on the upstream side of the photosensitive drum as viewed in the direction of the movement of the photosensitive member.

With this structure, when a seal member such as a flocked sheet contacting a photosensitive member and receiving a rotating force of the photosensitive member is adhered, displacement or peeling off of the seal can be completely prevented by pressing the upper portion of the seal by a pressing member from the upstream side as viewed in the direction of the movement of the photosensitive member (the direction of rotating in case of a photosensitive drum). Further, partial curling up of the seal can be prevented, and thereby an adhesive agent used for adhering the seal can be prevented from staining the photosensitive member.

The above-mentioned and other objects, features and advantages of the present invention will become more apparent from the following description of the embodiments.

DESCRIPTION OF THE PREFERRED EMBODIMENTS

Figure 1:
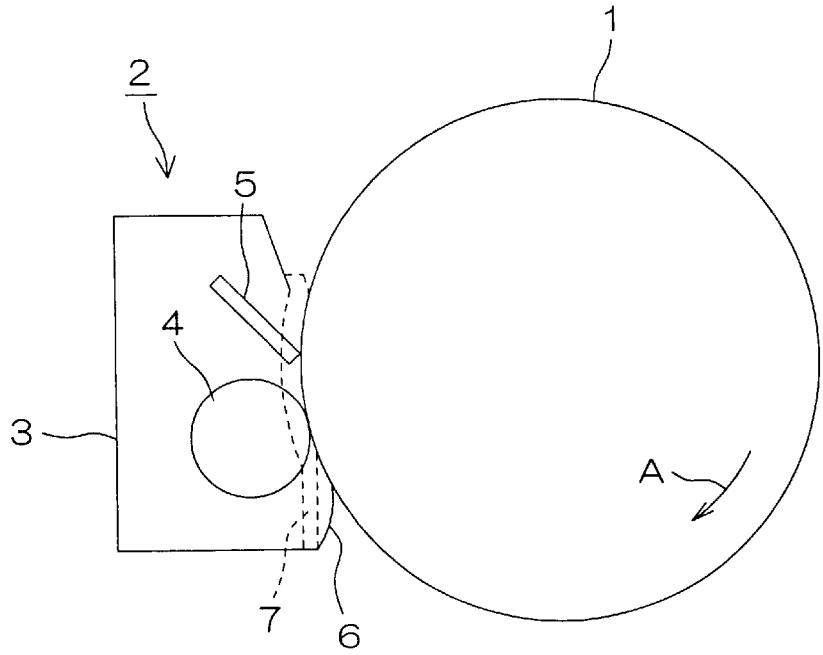
FIG. 1 is a schematic sectional view showing the position relationship between a photosensitive drum and a cleaning device.

FIG. 1 is a schematic sectional view showing the position relationship between a photosensitive drum and a cleaning device.

A photosensitive drum 1 is a cylindrical member having a longitudinal axis perpendicular to the paper surface of the drawing, and a photosensitive layer is formed on the outer circumferential surface of the cylindrical member. The photosensitive drum 1 rotates clockwise as indicated by the arrow A, and is successively subjected to charging, exposing, developing and transferring, though not shown. Then, after transferring, the surface of the photosensitive drum 1 rotates to a cleaning device 2.

The cleaning device 2 has a housing 3. The housing 3 is provided with an end face defining an opening opposed to the surface of the photosensitive drum 1. The housing 3 contains a fur brush 4 on its upstream side as viewed in the direction of the rotation of the photosensitive drum 1, and a scraping blade 5 on its downstream side. When the fur brush 4 rotates, soft hair tips thereof contact the surface of the photosensitive drum 1 and take residual toner into the housing 3. And the scraping blade 5 contacts the surface of the photosensitive drum 1 and scrapes residual toner down into the housing 3.

It is necessary to be took the residual toner scraped by the fur brush 4 and the scraping blade 5 into the housing and to surely prevent the toner from falling down through a clearance between the housing 3 and the photosensitive drum 1. For this purpose, an upstream seal (urethane sheet seal) 6 is adhered to the lower end of the end face of the opening of the housing 3 (end face positioned at upstream side of the opening as viewed in the direction of the rotation of the photosensitive drum 1). Further, side seals (flocked seals) 7 as shown in broken lines are adhered respectively to both ends of the housing 3, namely, to the front side end face and the back side end face, as viewed in the longitudinal direction, of the photosensitive drum 1.

By means of the upstream seal 6 and the side seals 7 provided at both ends, clearances between the surface of the photosensitive drum 1 and the cleaning device 2 are sealed and the scraped toner can be prevented from leaking through the clearances.

Figure 2:
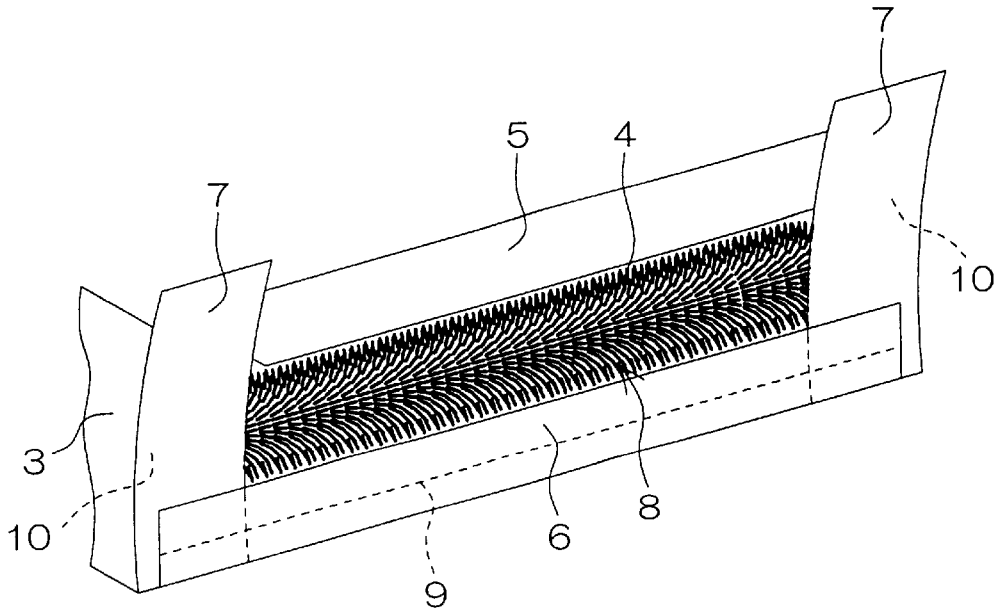
FIG. 2 is a schematic perspective view of a cleaning device according to an embodiment of the present invention seen from the photosensitive drum side.

FIG. 2 is a schematic perspective view of a cleaning device 2 as viewed from the photosensitive drum side. As shown in FIG. 2, the housing 3 is provided with an opening 8 opposed to the surface of the photosensitive drum 1. An upstream end face 9 and side end faces 10 of the housing 2 define the opening 8.

The side seals 7 as the first seals are adhered to both side end faces 10 respectively, and the upstream seal 6 as the second seal is adhered to the upstream end face 9 and the lower portions of the side seals 7.

Figure 3A:
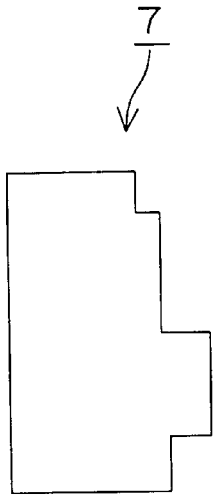
FIG. 3A is a front view of a side seal as a first seal.
Figure 3B:
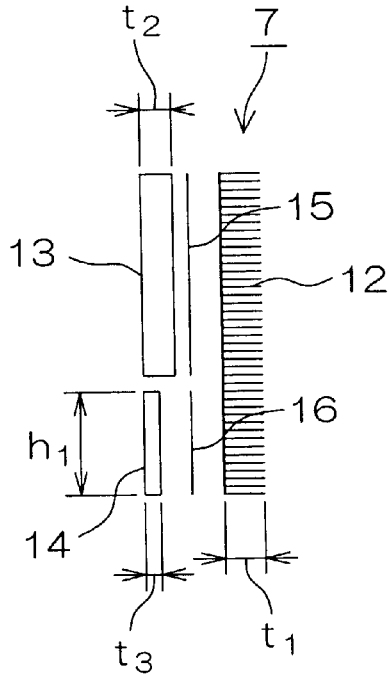
FIG. 3B is a decomposed view of the side seal as viewed from the left side surface.

FIG. 3A is a front view of the side seal 7 as the first seal, which is a front view of the side seal 7 on the left side as viewed from the front, namely, a front view of the side seal of the front side in FIGS. 1 and 2. In connection with this, the side seal 7 on the right side has a symmetrical shape with this side seal 7 on the left side. FIG. 3B is a decomposed view of the side seal 7 on the left side as viewed from the left side face.

The side seal 7 includes a flocked sheet 12 and two divided seal bases 13, 14. The flocked sheet 12 is formed of, for example, an acrylic pile having a thickness $t_1$ of 2 mm. On the other hand, both of the seal bases 13, 14 are formed of PET film. The upper seal base 13 has a thickness $t_2$ of 0.25 mm while the lower seal base 14 has a thickness $t_3$ of 0.1 mm. The flocked sheet 12 and each of the seal bases 13, 14 are adhered together by means of double faced adhesive tapes 15, 16 respectively.

The height $h_1$ of the lower seal base 14 is, for example, 10.7 mm, which is rather large value near the height of the upstream seal (second seal) mentioned later.

Figure 4A:
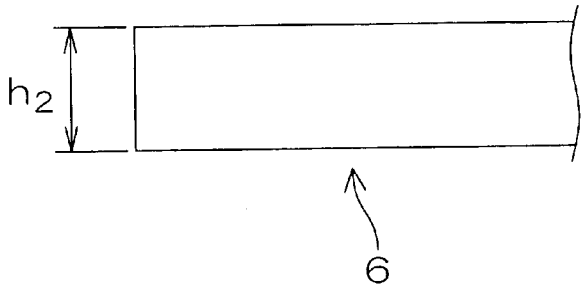
FIG. 4A is a front view of an upstream side seal.
Figure 4B:
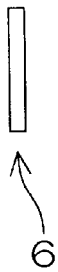
FIG. 4B is a side view of the upstream side seal.

FIGS. 4A, 4B are a front view and a side view respectively of the upstream seal 6. In this embodiment, the upstream seal 6 is a long and narrow rectangular sheet formed of urethane, and has a height $h_2$ of 7.5 mm.

Figure 5:
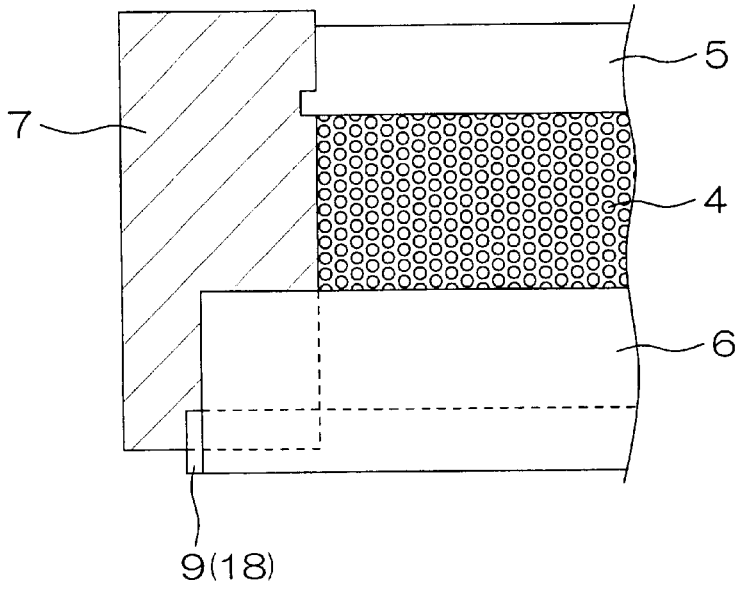
FIG. 5 is a front view showing the main portion of the cleaning device.
Figure 6:
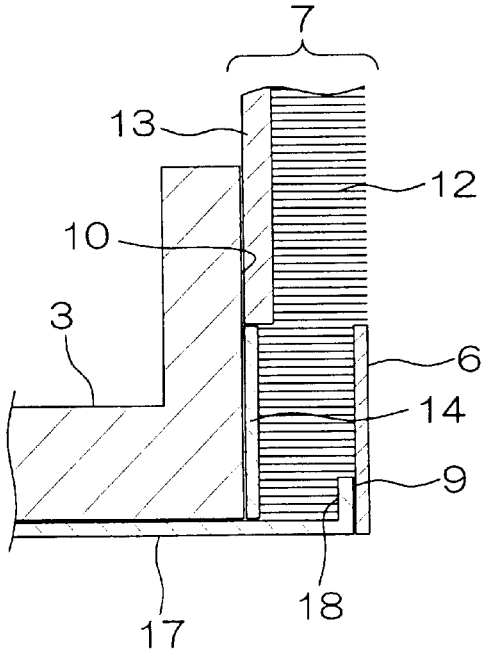
FIG. 6 is a left side view of the main portion of the cleaning device.

FIG. 5 is a front view showing an important portion of the cleaning device 2, and FIG. 6 is a left side view thereof. Referring to FIGS. 5 and 6, the housing 3 is provided with an open end face 10 in front thereof, and the side seal 7 is adhered to the end face 10. In more concrete, the back sides of the seal base 13, 14 of the side seal 7 are adhered to the end face 10 by means of, for example, double faced adhesive tapes (not shown). In order to reinforce this adherence, a fitting plate 17 having a hooked side shape is fitted from the lower side of the housing 3. Thereby, the side seal 7 is surely held by the housing 3 and a hooked portion 18 of the fitting plate 17. The upstream seal 6 is adhered to the front face 9 of the hooked portion 18 of the fitting plate 17. In other words, in this embodiment, the hooked portion 18 of the fitting plate 17 is an opening-defining member of the housing 3. In this condition, in the portion in which the upstream seal 6 and the side seal 7 overlap each other, the thickness of the seal base 14 of the side seal 7 is made smaller than that of the seal base 13 of the other portion. Consequently, no step is formed in the portion in which the upstream seal 6 and the side seal 7 overlap each other.

In case of providing a step on the end face 10 of the housing 3 so as to absorb the step in which the side seal 7 and the upstream seal 6 overlap each other, the seal base 13 is not along with the step on the end face 10 and a gap is produced. Therefore, by providing a step on the end face 10, toner is apt to leak through the gap as abovementioned.

According to this embodiment of the present invention, no gap nor clink is formed between the housing 3 and the seal bases 13, 14 of the side seal 7, and in addition, formation of any step in the portion in which the side seal 7 and the upstream seal 6 overlap each other can be prevented, as explained above. As a result, toner leakage from the housing 3 can be prevented and troubles such as plucking away of the upstream seal 6 by the rotating photosensitive drum 1 can be also prevented.

Figure 7:
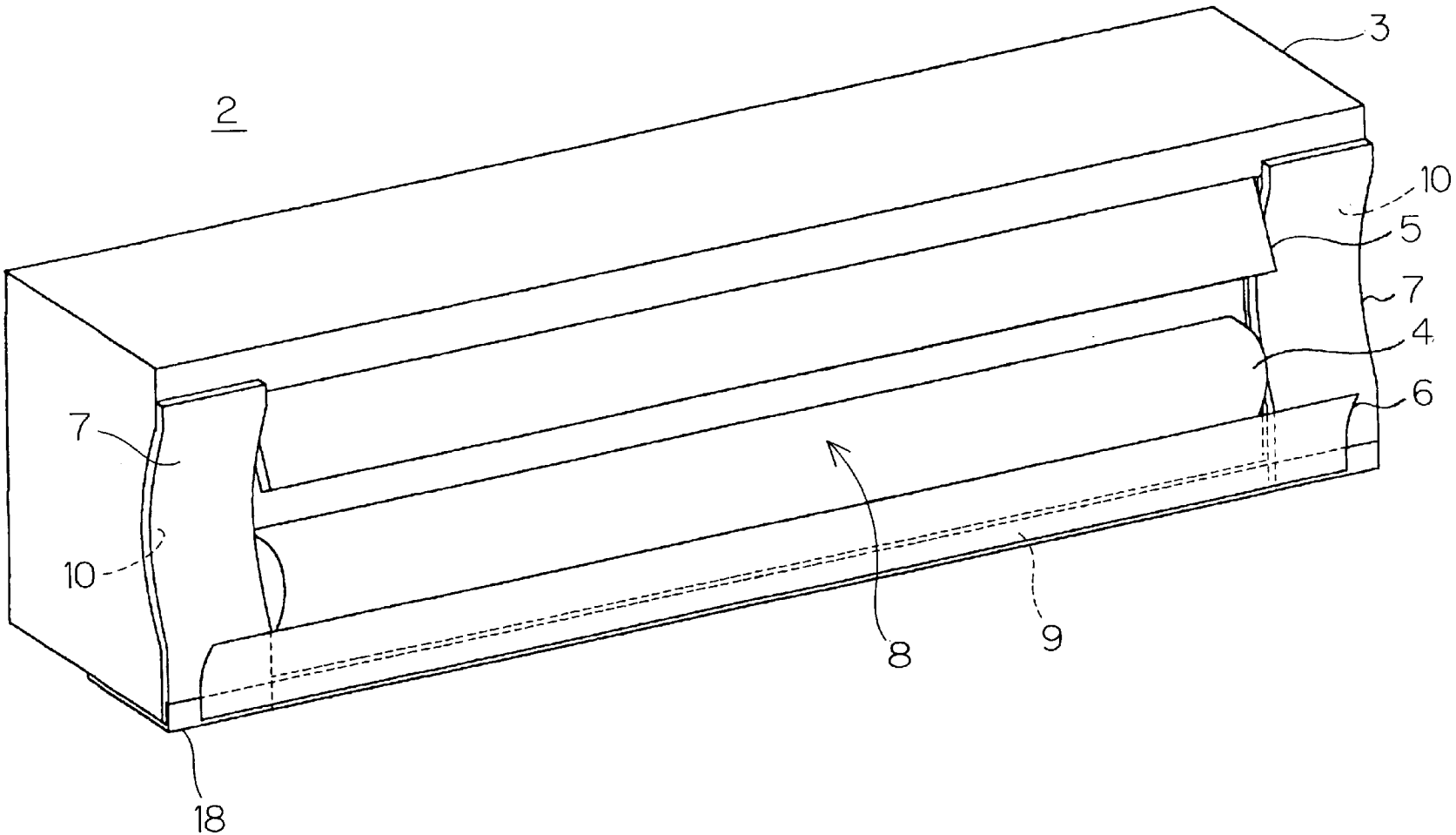
FIG. 7 is a schematic perspective view of a cleaning device according to another embodiment of the present invention as viewed from the photosensitive drum side.

FIG. 7 is a schematic perspective view of a cleaning device 2 according to another embodiment of the present invention as viewed from the photosensitive drum 1 side. The cleaning device 2 shown in FIG. 7 differs from the cleaning device of FIG. 2 in that a pressing member 18 extends along the upstream side end face 9 as viewed in the direction of the opening 8 to press the upstream ends of the right and left side seals 7. Further, the upstream seal 6 as the second seal is adhered to the pressing member 18. The upstream seal 6 is adhered to the upstream side end face 9 and the lower portions of the side seals 7.

Figure 8:
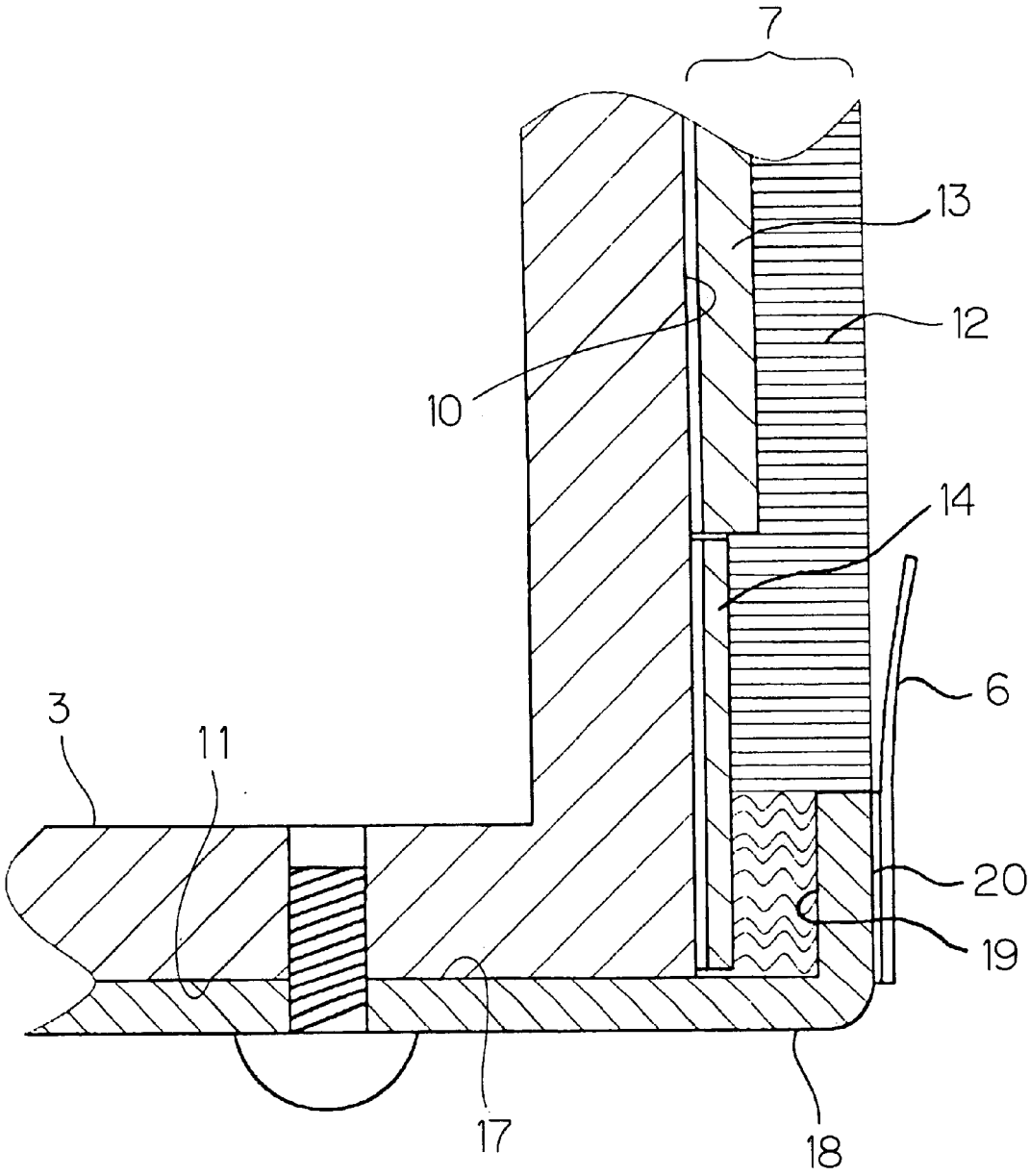
FIG. 8 is a sectional view of the main portion of upstream side of a side end surface 10 of a housing in a cleaning device according to another embodiment of the present invention.

FIG. 8 is a sectional view of the main portion of upstream end of a side end surface 10 of the housing 3. Referring to FIG. 8, the disposition of the side seal 7 and the pressing member 18 will be described in the following in detail.

In FIG. 8, in the side face of the housing 3, the side seal 7, in which the flocked seal 12 is provided on the seal bases 13, 14, is adhered to the upstream side end of the side end face 10 by means of a double faced adhesive tape and the like.

Figure 9:
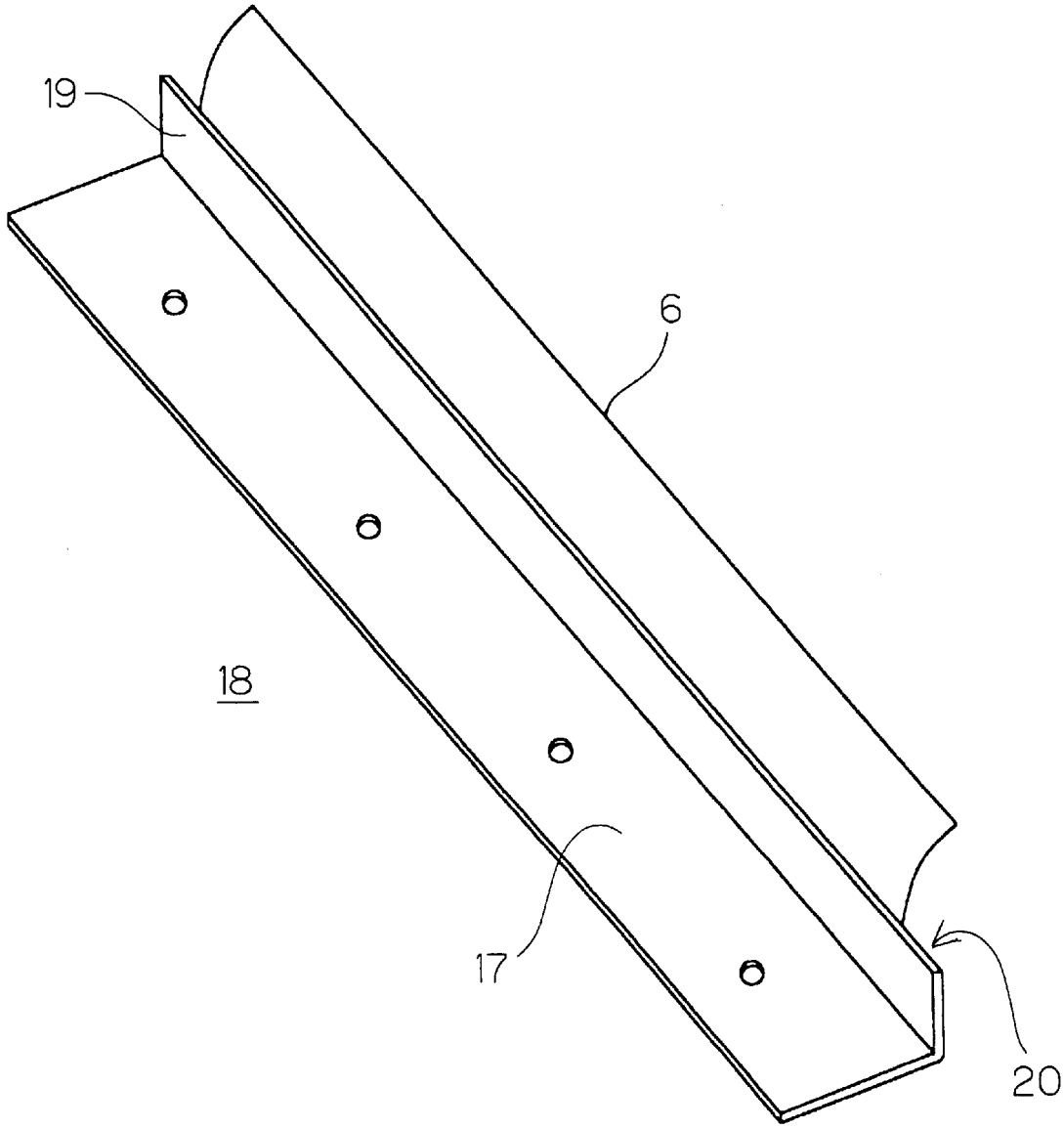
FIG. 9 is a perspective view of a pressing member.

Further, the pressing member 18 is a long member formed by bending a thin plate of a metal such as iron (having a thickness of, for example, 1.2 mm) to have a L-shaped section as shown in FIG. 9. One side of the L-shape is a fitting surface 17 to be fitted to the bottom surface 11 of the cleaning housing 3. The other side of the L-shape is a pressing surface 19 (having a width of, for example, 3 mm) for inwardly pressing the upstream side end of the side seal 7. Further, the surface opposite to the pressing surface 19 is a seal adhering surface 20 for adhering the upstream seal 6 thereto. The upstream seal 6 is adhered to the seal adhering surface 20 by means of a double faced adhesive tape or the like so as to the lower end of the upstream seal 6 being substantially in line with the lower end of the seal adhering surface 20. The upstream seal 6 is a polyurethane sheet, for example, having a thickness of 0.1 mm and a width of 8 mm, and is adhered with a free end thereof protruding upwardly (toward the downstream side) from the seal adhering surface 20.

As shown in FIGS. 7 and 8, the pressing member 18 is fixed to the housing 3 by screws with the fitting surface 17 opposed to the bottom surface 11 of the housing 3, in such a position that the length direction of the pressing member 18 covers substantially the whole of the upstream ends of the right and left side seals 7, 7, and the side seal 7 is held between the side end face 10 as an adhering surface of the side seal 7 and the pressing surface 19 of the pressing member 18.

Figure 10A:
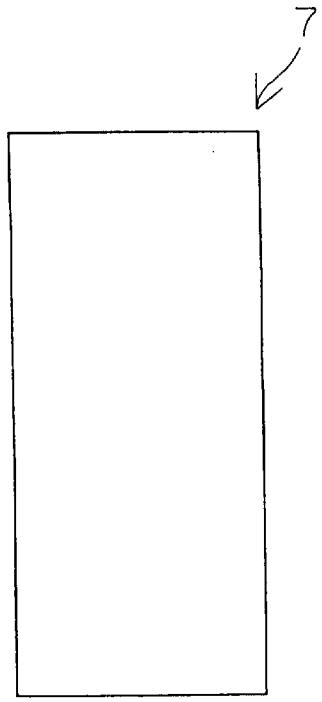
FIG. 10A is a front view of a side seal in a cleaning device according to another embodiment of the present invention.
Figure 10B:
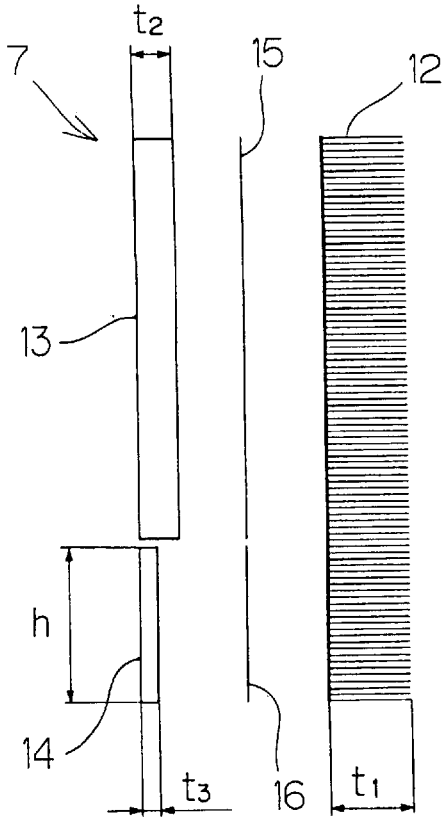
FIG. 10B is a decomposed view of the side seal as viewed from the left side surface.
Figure 11:
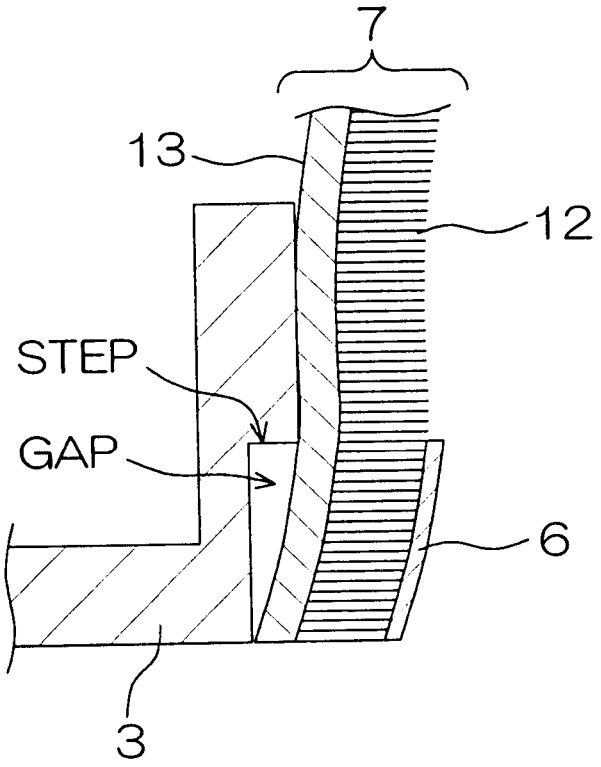
FIG. 11 PRIOR ART
FIG. 11 is a schematic view for explaining a drawback of a step formed on an end face of the housing.

The structure of the side seal 7 is as shown in FIGS. 10A and 10B.

FIG. 10A is a front view of the side seal 7 on the left side as viewed from the front. The side seal 7 on the right side has a symmetrical shape to the side seal 7 on the left side. FIG. 10B is a decomposed view of the left side seal 7 as viewed from the left side surface.

Each of these side seals 7 has basically the same structure as that of each side seal provided in the cleaning device of the first embodiment.

In this embodiment, since the pressing surface 19 of the abovementioned pressing member 18 has a thickness of 3 mm, the pressing surface 19 presses a portion of the thin lower seal base 14 from the front of the flocked sheet 12. Therefore, the pressing member 18 is prevented from protruding out of the side seal 7 as shown in FIG. 8, and thus the surface of the photosensitive drum is prevented from being damaged.

Since a cleaning device 2 according to the present invention provided with side seals 7 and a pressing member 18 is in combination with a photosensitive drum 1 as shown in FIG. 1, flocked sheet surfaces of the side seals 7 abut on the circumferential surface of the photosensitive drum 1, and the upper end (free end) of the upstream seal 6 contacts the circumferential surface of the photosensitive drum 1.

When the photosensitive drum 1 rotates in the direction indicated by the arrow A, the flocked sheet 12 of the side seal 7 receives a displacing force in the direction of the rotation. However, the side seal 7, being pressed on the upstream side by the pressing member 18, can sufficiently resist the displacing force, and therefore the side seal 7 can be prevented from being displaced or peeled off, so that toner leakage can be surely prevented. If the side seal 7 is pressed at a position other than the upstream side by the pressing member, such an effect cannot be obtained at all. If the side seal 7 is pressed, for example, on the downstream side, the side seal 7 is easily displaced or peeled off by the rotating force of the photosensitive drum 1.

Further, since the side seal 7 is pressed from the upper surface of the flocked sheet by the pressing member 18 as shown in FIG. 8, the flocked portion is prevented from fraying or being peeled off, and therefore high pressure leakage, caused by fallen hairs transported by the rotating photosensitive drum 1 to a charging section or the like, can be preliminarily prevented from occurring.

Further, since the seal base of the side seal 7 is made thinner in the portion in which the pressing member presses, the pressing member does not protrude, thus giving no damage to the photosensitive drum 1.

Further, since the pressing member is formed of a metal plate, it is highly rigid, and it can surely press the seals even if it is made thin.

Furthermore, since the pressing member can function as a base for another seal member (the upstream seal in the abovementioned embodiment), parts of the device can be reduced in number to be advantageous in view of downsizing and cost-down.

The present invention is not limited by the abovementioned embodiments but can be variously changed within the scope of the appended claims.

For example, though a cleaning device applied to a photosensitive drum is described as an example in the abovementioned embodiment, a photosensitive member for forming electrostatic latent images is not limited to a drum-shaped one and a cleaning device according to the present invention can be also applied to a belt-type photosensitive member.

Further, the side seal 7 in the abovementioned embodiment is one in which the front surface thereof is formed only of a flocked sheet, but it is not limited thereto and may be formed of other seal member such as sponge or rubber. Especially, since the portion on the upstream side to be pressed by the pressing member does not contact the photosensitive drum, the front side of this portion may be replaced by sponge, rubber or the like.

This application corresponds to a Japanese Patent Application No.2001-365838 filed in the Japanese Patent Office on Nov. 29, 2001 and the Japanese Patent Application No. 2001-365424 filed in the Japanese Patent Office on Nov. 30, 2001, and the whole disclosures of these Japanese applications are incorporated herein by reference.

What is claimed is:

1. A cleaning device for scraping toner remaining on the surface of a photosensitive member after toner image transferring, comprising:

a housing provided with end faces defining an opening opposed to the surface of the photosensitive member, and first seals and a second seal adhered to the end faces of the housing for sealing the space between the end faces and the surface of the photosensitive member, the first seals and the second seal partly overlapping each other, the first seals each including a seal base and a flocked sheet layered on the seal base, the portion of the seal base where the second seal overlaps being made smaller in thickness than the portion of the seal base where the second seal does not overlap.

2. A cleaning device according to claim 1, wherein, in the portion where the each first seal and the second seal overlap each other, the second seal is adhered onto each first seal.

3. A cleaning device according to claim 2, wherein the cleaning device is applied to a photosensitive drum the circumferential surface of which is a photosensitive surface, the end faces of the housing defining the opening including curved end faces curved in line with the edges of the photosensitive drum respectively, and a linear end face in line with the longitudinal direction of the photosensitive drum, the first seal being adhered to the curved end face and the second seal being adhered to the linear end face.

4. A cleaning device for scraping toner remaining on the surface of a photosensitive member after toner image transferring, comprising:

a housing provided with an end face defining an opening opposed to the surface of the photosensitive member;

a seal including a flocked sheet adhered to the end face for sealing the space between the end face and the surface of the photosensitive member; and a pressing member for pressing a first portion of the seal from the upper surface thereof, the first portion of the seal abutting on an upstream side of the photosensitive drum as viewed in the direction of the movement of the photosensitive member, wherein the seal includes a seal base on which a flocked sheet is layered, and wherein a first portion of the seal base, corresponding to a first portion of the seal which is pressed by the pressing member, is smaller in thickness than a second portion of the seal base which corresponds to a second portion of the seal which is not pressed by the pressing member.

5. A cleaning device according to claim 4, wherein the pressing member is formed of a metal plate.

6. A cleaning device according to claim 5, wherein, for sealing the open end face of the housing, a second seal is provided on the pressing member.

* * * * *